US006662981B2

(12) United States Patent
McUmber

(10) Patent No.: US 6,662,981 B2
(45) Date of Patent: Dec. 16, 2003

(54) BACK-SUPPORTED LOAD-CARRYING MECHANISM WITH SUSPENSION-MOUNTED PIVOTING LUMBAR SUPPORT

(75) Inventor: Andrew McUmber, Garland, TX (US)

(73) Assignee: Azora, L.L.C., Dallas, TX (US)

( * ) Notice: Subject to any disclaimer, the term of this patent is extended or adjusted under 35 U.S.C. 154(b) by 0 days.

(21) Appl. No.: 10/228,908

(22) Filed: Aug. 27, 2002

(65) Prior Publication Data

US 2003/0000974 A1 Jan. 2, 2003

Related U.S. Application Data

(63) Continuation-in-part of application No. 09/774,318, filed on Jan. 31, 2001, now Pat. No. 6,464,118.

(51) Int. Cl.[7] ..... A45F 4/00

(52) U.S. Cl. ..... 224/155; 224/634; 297/16.1; 297/129

(58) Field of Search ..... 224/155, 270, 224/634, 635; 297/16.1, 129

(56) References Cited

U.S. PATENT DOCUMENTS

| | | | | | |
|---|---|---|---|---|---|
| 2,712,404 | A | * | 7/1955 | Miller | 224/181 |
| 3,292,830 | A | * | 12/1966 | Mack | 16/371 |
| 4,450,990 | A | * | 5/1984 | Bolstad | 224/155 |
| 4,489,866 | A | * | 12/1984 | Korte | 224/155 |
| 4,720,029 | A | * | 1/1988 | Varanakis | 224/153 |
| 4,836,938 | A | * | 6/1989 | Kobasic | 224/153 |
| D306,379 | S | * | 3/1990 | Kobasic | D6/367 |
| 5,087,095 | A | * | 2/1992 | McFate | 224/155 |
| 5,131,575 | A | * | 7/1992 | Charest | 224/155 |
| 5,139,308 | A | * | 8/1992 | Ziman | 224/155 |
| 5,303,975 | A | * | 4/1994 | Asato | 224/155 |
| 5,381,941 | A | * | 1/1995 | Brune | 224/155 |
| 5,409,291 | A | * | 4/1995 | Lamb et al. | 297/129 |
| 5,527,089 | A | * | 6/1996 | Charest | 224/155 |
| 5,533,654 | A | * | 7/1996 | Holty et al. | 224/155 |
| 5,536,064 | A | * | 7/1996 | MacLean | 224/155 |
| 5,538,318 | A | * | 7/1996 | MacLean | 224/155 |
| 5,547,246 | A | * | 8/1996 | Lambert | 224/153 |
| 5,597,101 | A | * | 1/1997 | Barber et al. | 224/153 |
| 5,695,099 | A | * | 12/1997 | Strum | 224/155 |
| 5,868,462 | A | * | 2/1999 | Truax | 224/155 |
| 5,950,895 | A | * | 9/1999 | Zakarin | 224/645 |
| 5,975,389 | A | * | 11/1999 | Braun et al. | 182/187 |
| 6,048,023 | A | * | 4/2000 | Lampton | 297/129 |
| 6,095,599 | A | * | 8/2000 | Lambert | 224/155 |
| 6,250,712 | B1 | * | 6/2001 | Livington et al. | 297/129 |
| 6,464,118 | B2 | * | 10/2002 | McUmber | 224/155 |

FOREIGN PATENT DOCUMENTS

| | | | | |
|---|---|---|---|---|
| GB | 2278271 A | * | 11/1994 | 224/155 |
| WO | WO-98/38891 | * | 9/1998 | |

* cited by examiner

*Primary Examiner*—Gary E. Elkins
(74) *Attorney, Agent, or Firm*—Steven W. Smith

(57) ABSTRACT

A back-supported load-carrying mechanism that includes a rigid frame having a lower portion that includes an opening between a first vertical side and a second vertical side. A horizontal shaft is mounted to the sides and extends through the opening. A lumbar support element is pivotally mounted on the horizontal shaft. The horizontal shaft is mounted to the vertical sides of the frame with a suspension mechanism that enables each end of the horizontal shaft (and each side of the lumbar support element) to move fore and aft in relation to the frame. Tensioners mounted on the frame apply forward pressure to the shaft. Two rear leg extensions on each side of the frame enable the load-carrying mechanism to stand upright when placed on the ground. The lumbar support can pivot approximately 95 degrees to a position enabling the load-carrying mechanism to be utilized as a chair.

20 Claims, 7 Drawing Sheets

BACK-SUPPORTED LOAD-CARRYING MECHANISM WITH SUSPENSION-MOUNTED PIVOTING LUMBAR SUPPORT

RELATED APPLICATIONS

This application is a continuation-in-part of copending U.S. patent application Ser. No. 09/774,318, entitled "Back-Supported Load-Carrying Mechanism With Pivoting Lumbar Support", filed Jan. 31, 2001, in the name of Andrew McUmber, U.S. Pat. No. 6,464,118 issued Oct. 15, 2002.

BACKGROUND OF THE INVENTION

1. Technical Field of the Invention

The present invention relates to a back-supported load-carrying mechanism and, in particular, to a back-supported load-carrying mechanism that includes a suspension-mounted, pivoting lumbar support element.

2. Description of Related Art

The use of backpack devices (backpacks and backpack frames used for carrying loads) is known in the prior art. Existing embodiments have utilized a single horizontal bar, a padded horizontal bar, a narrow strap, or molded pads to provide support for the backpack device in the lumbar region of the user's back. However, there are problems with the comfort and functionality of these existing lumbar supports. Due to the shortcomings of existing lumbar supports, backpack devices often slide down from the weight of the load being carried and tend to shift off center providing uneven weight distribution on the shoulders and back of the user. Further, existing lumbar supports do not conform to the backs of the wide variety of individuals wearing the backpack device.

It would be advantageous to have a back-supported load-carrying mechanism that overcomes the shortcomings of existing backpack devices. The present invention provides such a mechanism.

SUMMARY OF THE INVENTION

Accordingly, it is an object of the present invention to provide a new and improved back-supported load-carrying mechanism which includes a suspension-mounted pivoting lumbar support element to allow for an even distribution of cargo weight to the lower back of a user, and to provide a shock-absorbing mechanism, thus eliminating stress to the neck and back areas of the user.

In one aspect, the present invention is directed to a back-supported load-carrying mechanism that includes a rigid frame having an upper portion and a lower portion with an opening therein. A lumbar support element is pivotally mounted on a horizontal shaft in the opening in the lower portion of the frame, and is positioned to contact the lumbar region of a user's back. The load-carrying mechanism also includes a suspension mechanism that mounts the horizontal shaft to the frame and enables the horizontal shaft to move fore and aft in relation to the frame. The load-carrying mechanism may also include two rear leg extensions on each side of the frame that provide support for the load-carrying mechanism and enable the load-carrying mechanism to stand in an essentially vertical orientation when the load-carrying mechanism is removed by a user and placed on the ground.

In another aspect, the present invention is directed to a back-supported load-carrying mechanism that includes a rigid frame having an upper portion and a lower portion, the lower portion including a first vertical side and a second vertical side forming an opening therebetween. A horizontal shaft is mounted to the first and second vertical sides and extends through the opening in the lower portion of the frame. A lumbar support element is pivotally mounted on the horizontal shaft. The lumbar support element extends horizontally from the first vertical side to the second vertical side of the frame, and extends vertically approximately halfway up the frame. The horizontal shaft is mounted to the first and second vertical sides of the frame with a suspension mechanism that enables the horizontal shaft (and lumbar support element) to move fore and aft in relation to the frame. The suspension mechanism may enable each end of the horizontal shaft, and thus each side of the lumbar support, to move fore and aft independently of the other end.

In yet another aspect, the present invention is directed to a back-supported load-carrying mechanism that includes a rigid frame and a floating lumbar support element. The frame has an upper portion and a lower portion with an opening therein. The floating lumbar support element is suspendably mounted in the opening in the lower portion so that the lumbar support element can pivot around a horizontal axis while also moving fore and aft in relation to the frame.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described preferred embodiments of the invention.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

The above-described figures illustrate a back-supported load-carrying mechanism 10 with a pivoting lumbar support element 18. The pivoting lumbar support element provides the mechanism with consistent weight distribution even when the user is performing physical activities involving bending at the waist and leaning from side-to-side because the lumbar support element pivots proportionately with the users varying body position. The mechanism effectively shifts the weight of the load from the user's shoulders to a broad area of the user's lower back.

Figure 1:
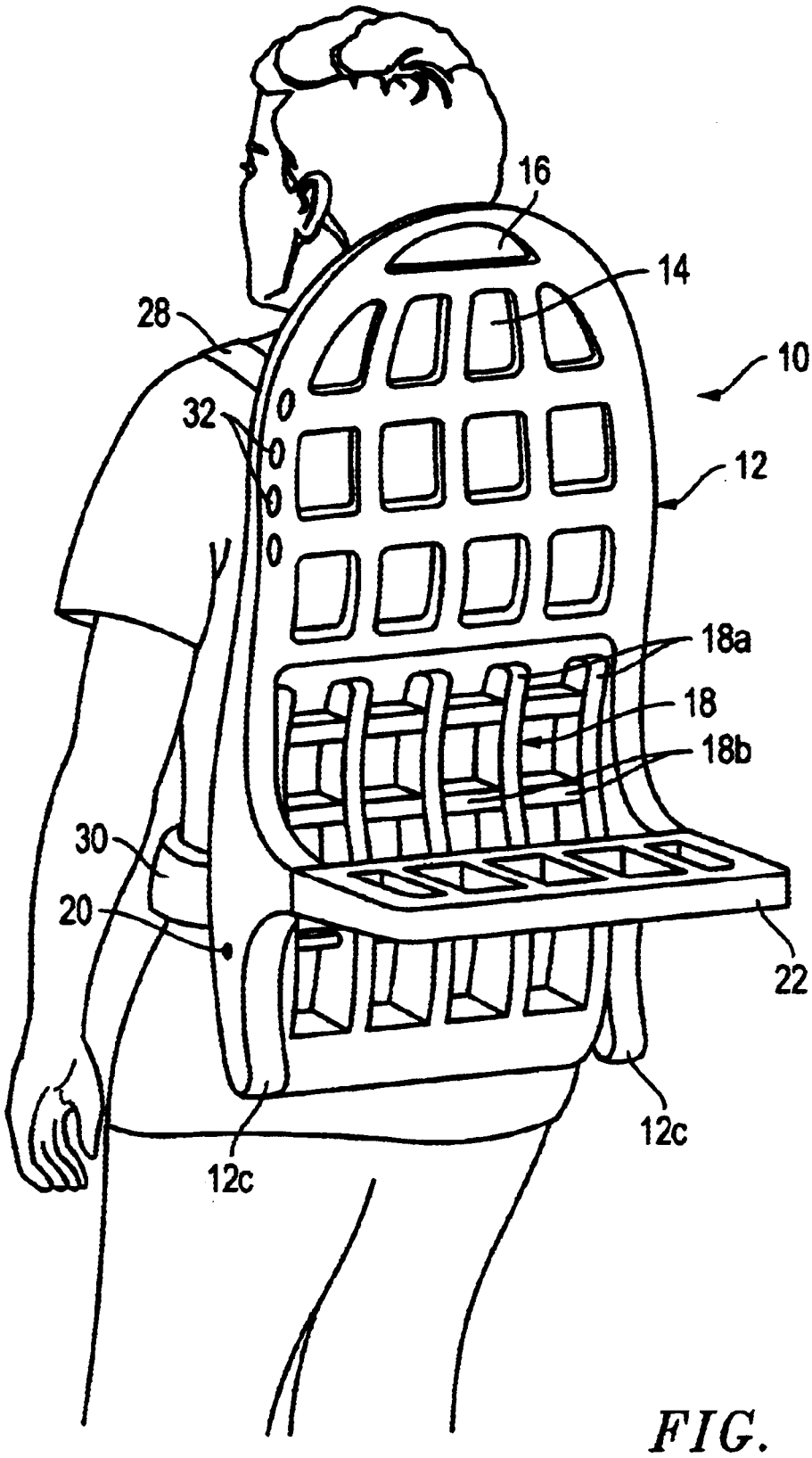
FIG. 1 is a rear perspective view of a first embodiment of the present invention in its folded configuration.

FIG. 1 is a rear perspective view of the first embodiment of the present invention in its folded configuration. The back-supported load-carrying mechanism 10 includes a molded frame 12. The front side of the frame (the side resting against the user's back) is designed to mimic the curvature of the spine. The front side of the frame has a region of convex curvature 12*a* (see FIG. 2) throughout the thoracic, lumbar, and upper sacrum areas of the back. The frame transitions to a region of concave curvature 12*b* just above the thoracic region towards the upper back, and neck areas.

The frame 12 has a raised lip edge around all the forward facing surfaces for accepting, containing, and/or protecting the edges of a polyolefin foam inlay. This foam is applied to all surfaces of the back-supported load-carrying mechanism which come in direct contact with the user's body. This includes the molded back-support portion of the frame, the rear and front surfaces of the lumbar support element 18 and both integrated vertical frame extensions 12*c*. In the first embodiment, the foam inlay is a closed-cell cross-linked polyofin foam product. Actual foam density, type and color may vary depending on the specific use application or style. This is a lightweight water-resistant product that provides comfort and cushion to any body parts with which it comes in contact.

The frame has a plurality of large openings 14 molded in the upper back, shoulder and neck regions to decrease weight and provide ventilation. An elliptical-shaped opening 16 at the top of the frame 12 provides a handle for carrying the back-supported load-carrying mechanism when it is not being worn. Several holes 32 running from the front to the back of the frame act as tie down points to secure the load being carried and to provide for additional items to be affixed or temporarily tied to the mechanism. Two frame extensions 12*c* extend downward to form the base of the frame on each side.

A load-support piece 22 may be connected to the frame extensions 12*c* to provide a support shelf for the load being carried and to transfer the weight of the load to the lower lumbar and upper hip regions rather than to the neck and shoulder areas of the user. The load-support piece is interchangeable, and different load-support pieces are designed to hold varying selected items such as camping gear, drink coolers, scuba tanks, and other specific use items. A male extension 24 on each side of the load support piece slides into and interlocks with a female connector 26 such as a four-sided open channel (see FIG. 2) formed in the rear side of each frame extension 12*c*.

Figure 5:
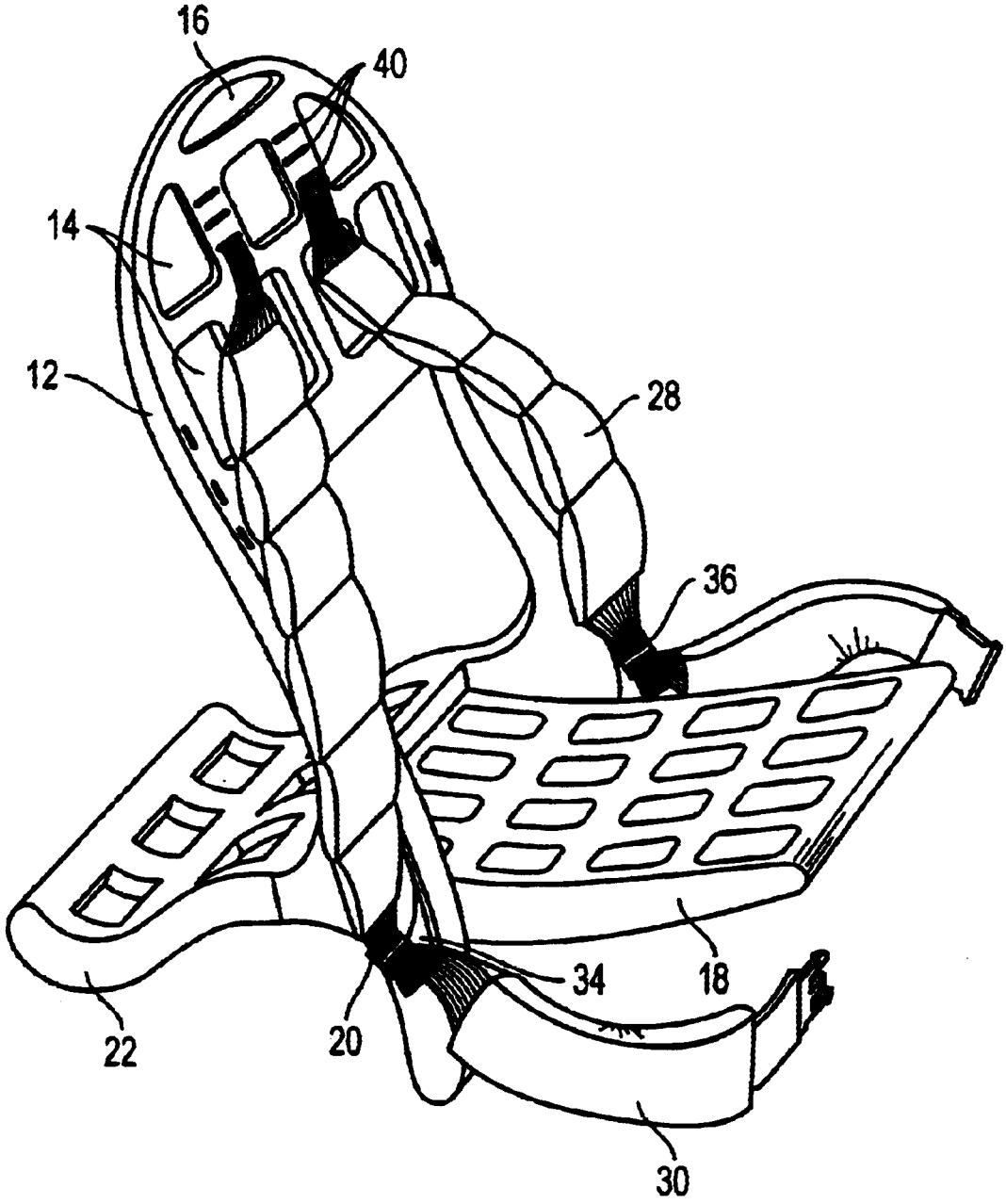
FIG. 5 is a front perspective view of the first embodiment of the present invention in its unfolded configuration.

An ergonomically designed lumbar support element 18 is pivotally mounted in the lower portion of the frame 12 between the frame extensions 12*c*. The lumbar support element may be constructed as a plurality of vertically oriented sub-elements 18*a* connected by horizontal cross pieces 18*b*. The sub-elements extend vertically, approximately halfway up the back of the user. The lumbar support element extends horizontally the full width of the frame, thus providing a large area of surface contact with the user's back. The lumbar support element can also be constructed with an open grid design as shown in FIG. 5.

The lumbar support element 18 pivots around a horizontal axle 20, mounted to each of the frame extensions 12*c* approximately ¼ to ⅓ of the way up the lumbar support element. The axle is a rod made from metal or another suitable rigid material, that runs horizontally through the entire lumbar support element 18, and is mounted in the frame extensions. The back-supported load-carrying mechanism may be attached to the user's body by the use of shoulder straps 28 and a waist strap 30.

The frame and lumbar support element may be constructed of any suitable lightweight, rigid material such as wood, plastic, aluminum, and so on. In the first embodiment, the frame and lumbar support element are constructed from an injection-molded or compression-molded plastic/graphite composite. In general, graphite composites provide the best strength-to-weight ratio, but are more expensive than other materials available, such as polycarbonates, nylon and fiberglass. Poly-carbonate plastics provide sufficient strength at a lower cost, but may be heavier than graphite composites. Suitable materials may also be formed from metals such as tungsten or copper/carbon/aluminum composites.

Figure 2:
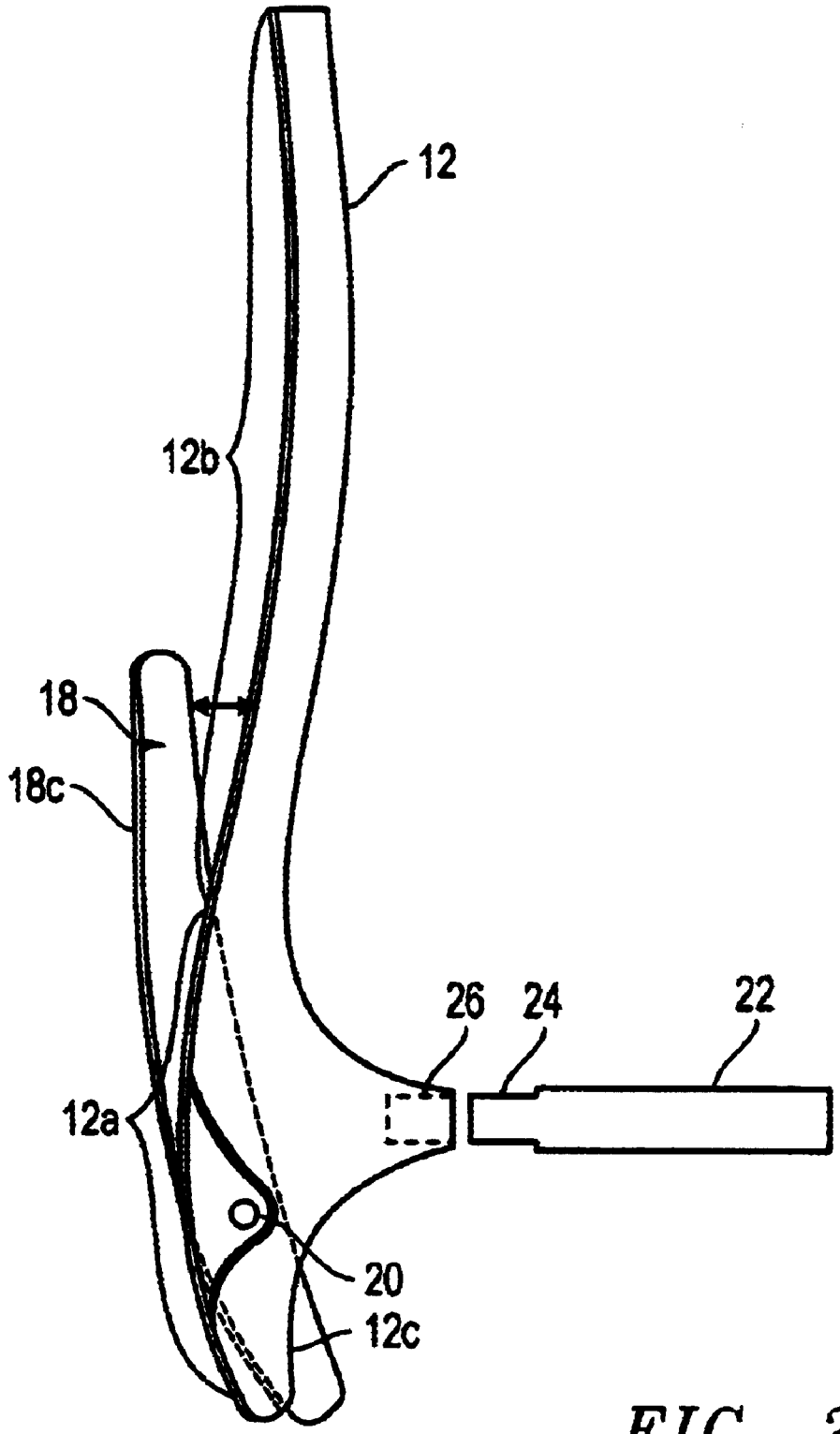
FIG. 2 is a side elevational view of the first embodiment of the present invention with the lumbar support element pivoting forward and downward.

FIG. 2 is a side elevational view of the first embodiment of the present invention with the lumbar support element 18 pivoting forward and downward. When the back-supported load-carrying mechanism is worn on the back, the pivoting lumbar support element 18 changes its angle to correlate with the user's body positions, thereby distributing the weight of the load consistently to the hips and upper sacrum region of the user which eliminates stress to the neck and upper back areas of the user. The total pivoting range of the lumbar support element is approximately 105 degrees, 95 degrees in the forward direction and 10 degrees in the rearward direction. The surface of the lumbar support element that contacts the user's back is curved to provide an anthropometrically correct curvature, matching the curvature of the user's back. The front surface is also covered by the non-sliding foam inlay 18*c*. Thus, the pivoting of the lumbar support element, the curvature of its surface, the large area of surface contact between the lumbar support element and the user's back, and the non-sliding foam inlay utilized on the lumbar support element prevent the pack from sliding down the user's back or slipping from side to side during use.

Figure 3:
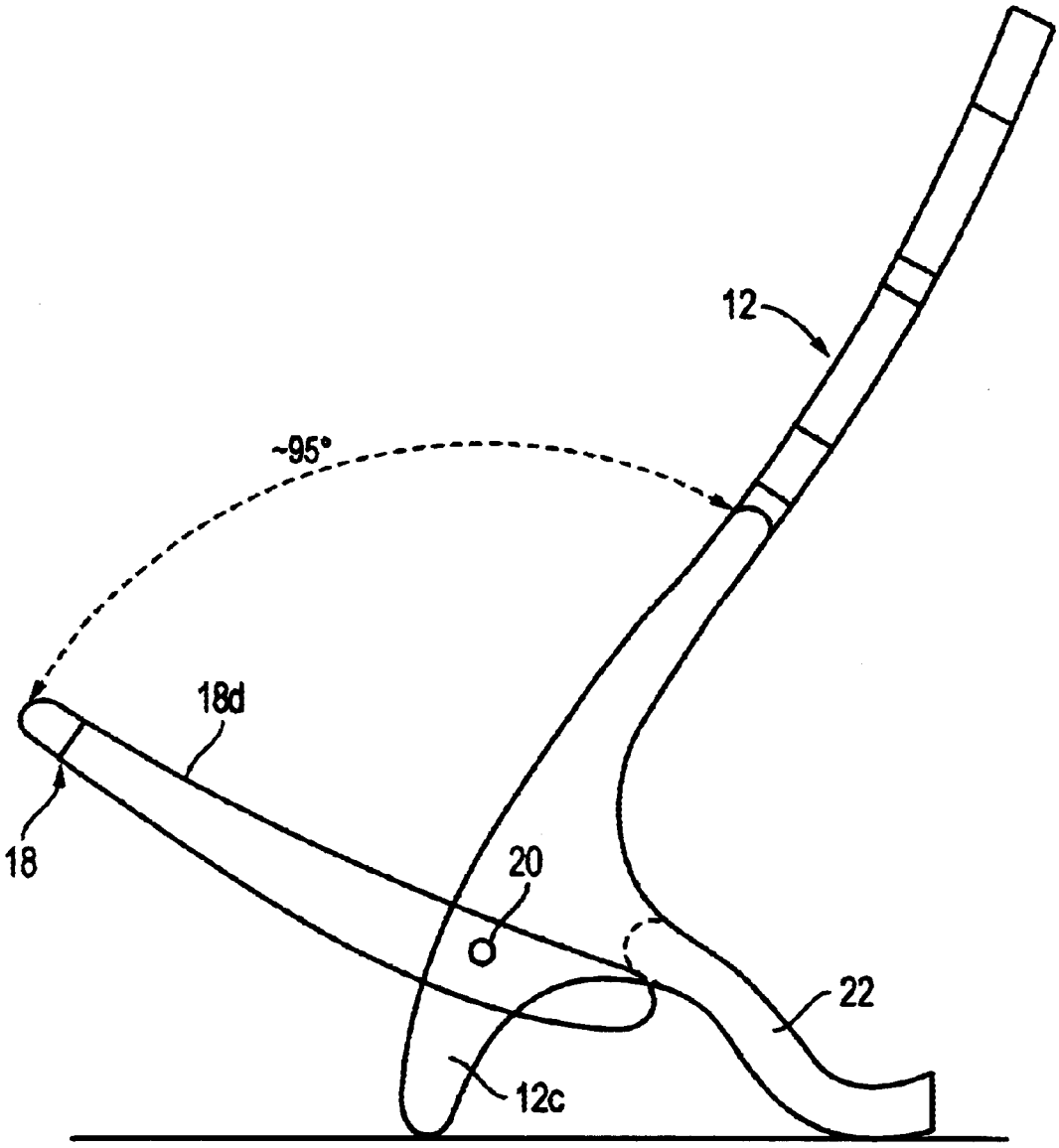
FIG. 3 is a side elevational view of the first embodiment of the present invention with the lumbar support element in a fully downward position to form a seat.

FIG. 3 is a side elevation view of the first embodiment of the present invention with the lumbar support element 18 in a fully downward position to form a seat. The lumbar support element can be converted into a seat by pivoting the lumbar support element 18 approximately 95 degrees downwards. Rotation of the lumbar support element is stopped at approximately 95 degrees when the lower end of the lumbar support element pivots rearward and upward, and contacts the lower surface of the load support piece 22. The reverse side of the pivoting lumbar support piece then provides a seat for the user which is concavely curved and covered in a foam inlay 18*d*.

The frame extensions 12*c* function as the front two legs of a chair when the lumbar support element 18 is pivoted to the seat position. The load support piece 22 functions as a rear support for the chair. The inclination of the back of the chair is thus determined by the length and curvature of the interchangeable load-support piece 22.

Figure 4A:
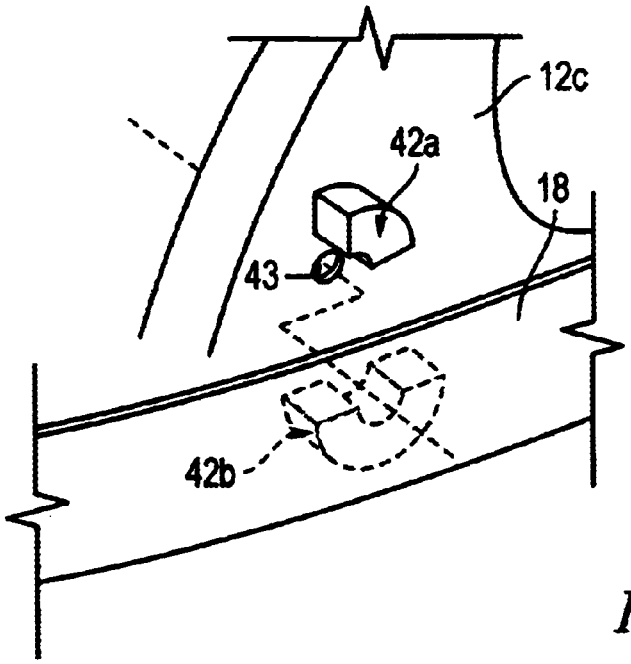
FIG. 4A is a partial exploded perspective view of an optional stopping mechanism for the lumbar support element in the first embodiment.

FIG. 4A is a partial exploded perspective view of an optional stopping mechanism 42 for the lumbar support element. A raised protrusion piece 42*a* is stationary and molded into the inside facing walls of each of the frame extensions 12*c*. A corresponding stop piece 42*b* is molded on either side of the lumbar support element, and rotates therewith. Both pieces surround a hole 43 through which the fixed axle is inserted.

Figure 4B:
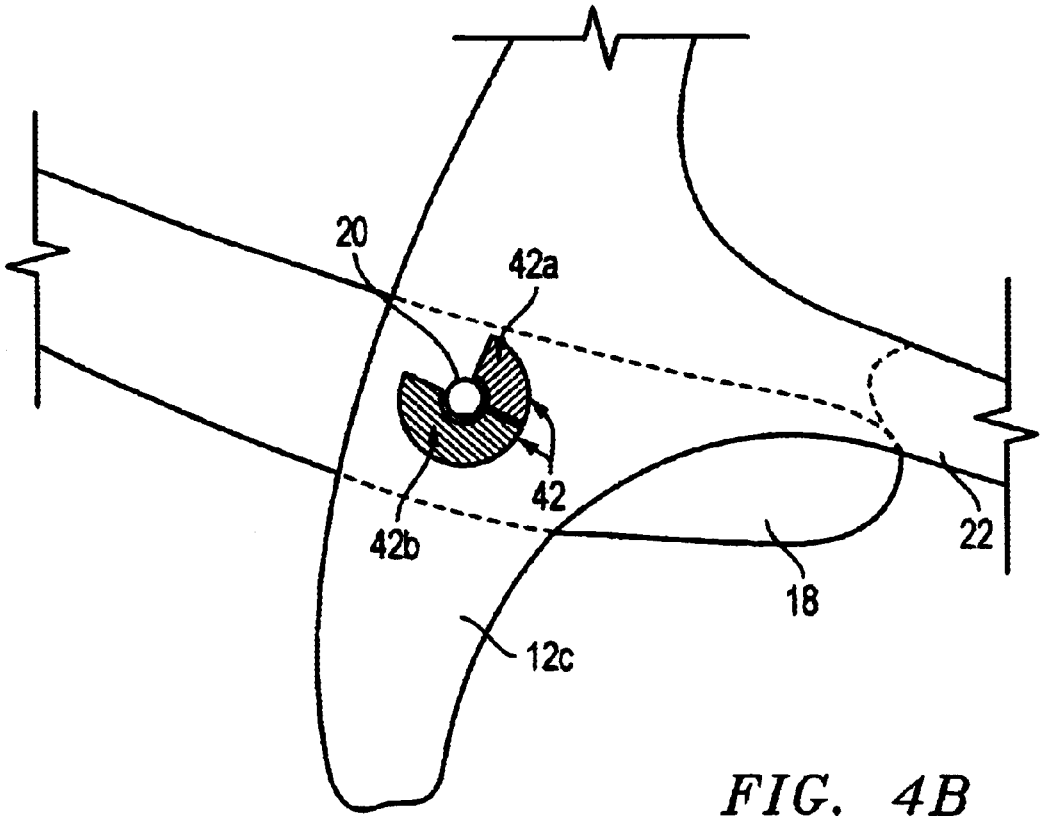
FIG. 4B is a partial side elevational view of the optional stopping mechanism of FIG. 4A when the pivoting lumbar support element is in the fully downward position.

FIG. 4B is a partial side elevational view of the optional stopping mechanism of FIG. 4A when the pivoting lumbar support element is in the fully downward position. Stoppage of the lumbar support element 18 occurs when the lumbar support stop piece 42*b* contacts the raised protrusion piece 42*a* on the frame extension. When the lumbar support element 18 is pivoted to the fully upward position, the other end of the stop piece 42*b* contacts the other end of the raised protrusion piece 42*a*, thereby stopping the lumbar support element.

FIG. 5 is a front perspective views of the first embodiment of the present invention in its unfolded configuration. A series of paired parallel slots 40 are cut through the back frame where the top ends of the shoulder straps 28 are inserted through and affixed to the frame. Each pair of slots allows the back-supported load-carrying mechanism to be placed at a different height in order to fit the user. The waist strap 30 is inserted through a slot 34 located on the front face of each vertical extension and exits through a slot located on the outer side of each vertical extension 36. These slots are located just above the axle 20. A buckle located on the other end of the waist strap allows the strap to be affixed around the user.

Once the back-supported load-carrying mechanism is unfolded, the user is provided with an off the ground, convenient chair since no fasteners, latches, screws, or tools are required to make this transformation possible. Conversion does not require any of the gear or load supported on the molded frame to be removed.

In an alternative embodiment, the load support piece can be eliminated, and a container such as a canvas bag may be attached to the frame for carrying articles such as books. This configuration more easily fits into school lockers, or is more easily carried on a school bus when the back-supported load-carrying mechanism is used as a book bag holder. The same benefits are provided by the pivoting lumbar support 18, preventing slippage of the book bag, and placing an even distribution of the weight on the user's hips and lower back areas. This is important for young children carrying a heavy load of books to school. This configuration also allows for larger items that may extend below the user's waist (such as a kayak) to be carried.

Figure 6:
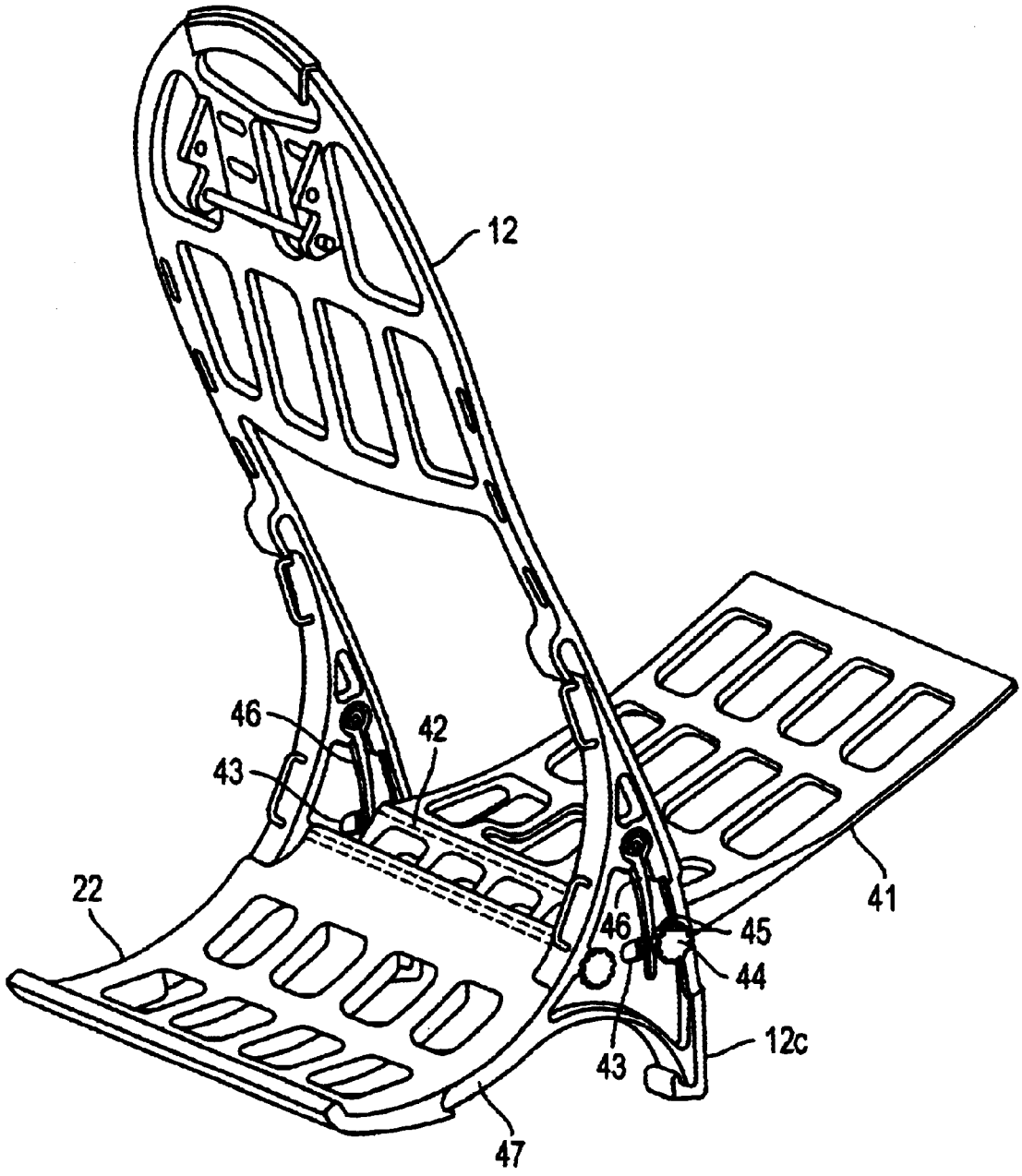
FIG. 6 is a right rear perspective view of a second embodiment of the present invention.

FIG. 6 is a right rear perspective view of a second embodiment of the present invention. The second embodiment includes a suspension-mounted, pivoting lumbar support 41. The lumbar support is mounted on a floating horizontal shaft 42, similar to the horizontal shaft 20 except that the floating horizontal shaft is free to move in the fore and aft direction along arcuate slots 43 formed in the frame extensions 12*c* on each side of the frame 12. The slots are essentially horizontal, but may be slightly arcuate, with the center of their radius of curvature fixed at a point above the slots. The ends of the horizontal shaft extend through the slots and a fastener 44 holds the shaft in place at each end. An anti-friction bushing 45 is mounted on the shaft near each end. The bushings rest within the arcuate slots and guide the shaft's movement fore and aft within the slots. The bushing at each end of the shaft slides in its respective slot independently of the other bushing. Therefore, while a symmetrical rearward force on the lumbar support will cause the entire horizontal shaft to slide uniformly rearward, an off-center force will result in one side of the shaft moving rearward more than the other side. Thus, the shaft and the lumbar support "float" as the dynamic load shifts against the user's back.

Figure 7:
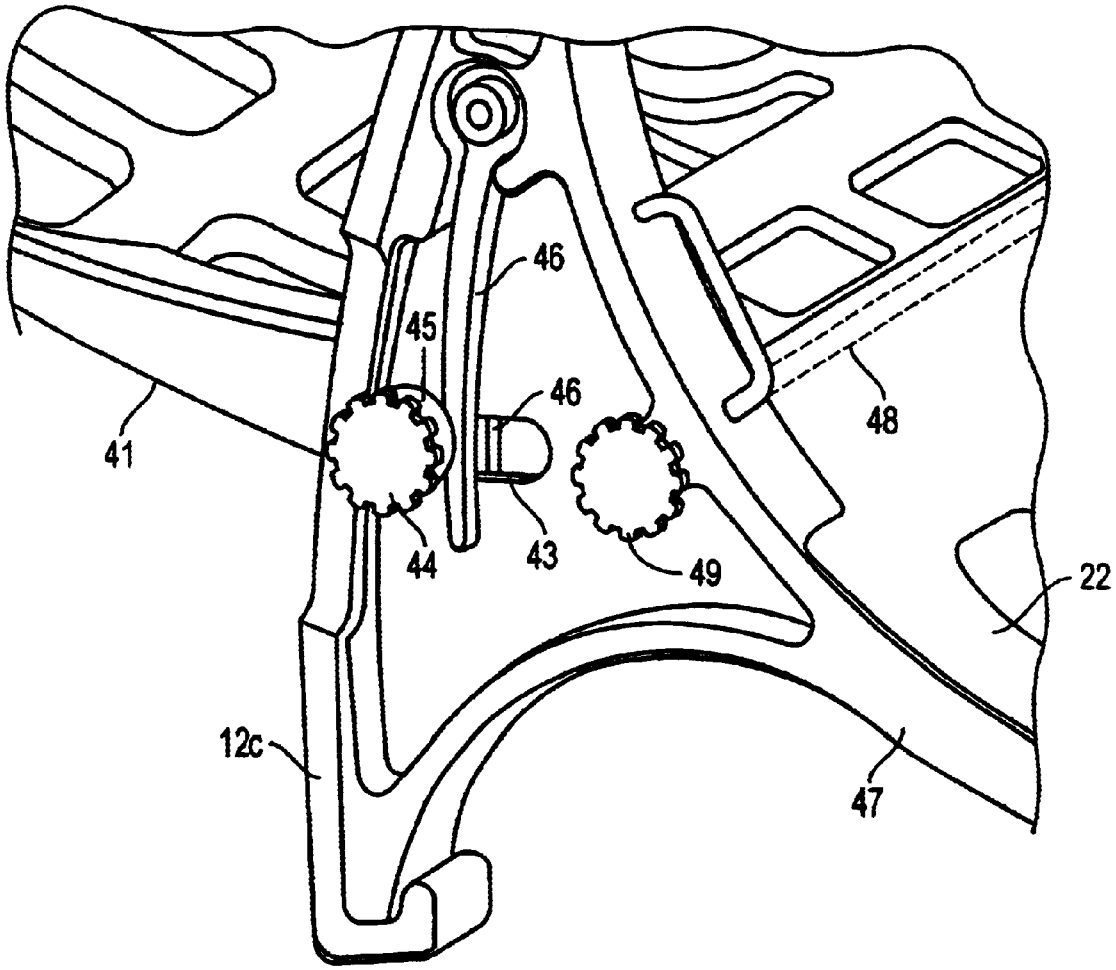
FIG. 7 is a left rear perspective view of a lower portion of the frame and frame extension illustrating in more detail, the components of the suspension-mounted horizontal shaft and pivoting lumbar support.

Referring briefly to FIG. 7, there is shown a left rear perspective view of a lower portion of the frame 12 and frame extension 12*c* illustrating in more detail, the components of the suspension-mounted horizontal shaft 42 and pivoting lumbar support 41. A flexible tensioner 46 is mounted above the arcuate horizontal slots 43 at the approximate center of their radius of curvature. The tensioner may be constructed of any suitable elastomeric material such as plastic, plastic composite, nylon, metal, or the like. The top of each tensioner is securely mounted into the frame extension 12*c* in a manner suitable to prevent the tensioner from rotating. The lower end of each tensioner contacts the anti-friction bushing 45 on each end of the shaft 42, applying forward pressure against the bushing and the shaft in the direction of the user's back. In this manner, as the load on the lumbar support pushes the shaft rearward, the shaft is free to move rearward in the slots against the forward force applied by the tensioners. Thus, the dynamic load is absorbed by the suspension-mounted pivoting lumbar support.

The tensioners 46 may be mounted on the outside of each frame extension 12*c*, thus providing a total of two tensioners. Optionally, the tensioners may be mounted on both the inside and the outside of each frame extension, thus providing a total of four tensioners. Additionally, the tensioners may be removably mounted so that tensioners of different stiffness may be interchanged to accommodate different load weights, according to the desires of the user.

Referring again to FIG. 6, as noted above, the ends of the shaft 42 are formed to accept the fastener 44 on each end to capture the shaft, lumbar support 41, bushings 45, and waist belt 30 (FIG. 5). The waist belt attaches to the fastener 44, thus forming a continuous belt around the user's waist which holds the lumbar support firmly against the lumbar region of the user's back. It can thus be appreciated that when the load-carrying mechanism is in actual use, the suspension-mounted lumbar support is essentially held stationary against the user's back by the waist belt, while the rigid frame 12 and load support element 22 are allowed to float independent of the lumbar support as the bushings 45 travel within the slots 43, and the frame pivots around the shaft 42.

Another change in the second embodiment is that the load support element 22 attaches to the frame 12 in a different manner. The load support element slides onto two rear leg extensions 47 on each side of the frame. A second horizontal shaft 48 extends through the forward portion of the load support element, and extends through each of the vertical frame extensions 12*c*. A second fastener 49 is attached to each end of the second horizontal shaft to retain the shaft in place. To remove the load support piece, one of the second fasteners is removed, and the second horizontal shaft is pulled out of the load support piece. The load support piece is then slid off of the rear leg extensions 47. The second horizontal shaft may then be replaced in the frame to function as a stop for the back end of the pivoting lumbar support when it is rotated to the seat position.

It is to be understood that even though numerous characteristics and advantages of the present invention have been set forth in the foregoing description, the disclosure is illustrative only, and changes may be made in detail, especially in matters of size, shape and arrangement of parts within the principles of the invention to the full extent indicated by the broad general meaning of the terms in which the appended claims are expressed.

What is claimed is:

1. A back-supported load-carrying mechanism comprising:

a rigid frame having an upper portion and a lower portion having an opening therein;

a lumbar support element pivotally mounted on a horizontal shaft in the opening in the lower portion, said lumbar support element being positioned to contact the lumbar region of a user's back; and a suspension mechanism for mounting the horizontal shaft to the frame, said suspension mechanism enabling the horizontal shaft to move fore and aft in relation to the frame.

2. The back-supported load-carrying mechanism of claim 1 wherein the lower portion of the frame includes a first vertical side and a second vertical side, and the lumbar support element extends horizontally from the first vertical side to the second vertical side of the frame, and extends vertically approximately halfway up the frame.

3. The back-supported load-carrying mechanism of claim 2 wherein the lumbar support element includes a front surface that contacts a user's back, and is anthropometrically shaped to fit the user's back.

4. The back-supported load-carrying mechanism of claim 3 wherein an essentially horizontal slot is formed in each of the first and second vertical sides of the frame, and the suspension mechanism includes means for mounting each end of the horizontal shaft within the slots in the first and second vertical sides.

5. The back-supported load-carrying mechanism of claim 4 wherein the means for mounting each end of the horizontal shaft within the slots includes a bushing at each end of the shaft through which each end of the shaft is mounted, said bushings being slidably mounted in the slots in the first and second vertical sides.

6. The back-supported load-carrying mechanism of claim 5 wherein the suspension mechanism also includes means for maintaining a forward force on the horizontal shaft toward the user's back, said forward force holding the shaft and the pivoting lumbar support element in a forward position unless a larger rearward force on the lumbar support element overcomes the forward force, causing the horizontal shaft to slide rearward in the slots.

7. The back-supported load-carrying mechanism of claim 6 wherein the means for maintaining a forward force on the horizontal shaft includes a tensioner mounted on each of the vertical sides of the frame, said tensioners providing the forward force on each of the slidably mounted bushings.

8. The back-supported load-carrying mechanism of claim 1 further comprising two rear leg extensions on each side of the frame, said leg extensions providing support for the load-carrying mechanism and enabling the load-carrying mechanism to stand in an essentially vertical orientation when the load-carrying mechanism is removed by a user and placed on the ground.

9. The back-supported load-carrying mechanism of claim 8 wherein the lumbar support element is mounted in a position that allows the lumbar support element to rotate approximately 95 degrees, from a first position essentially aligned with the frame when the load-carrying mechanism is being worn by the user, to a second position essentially perpendicular to the frame when the load-carrying mechanism is removed by the user and utilized as a chair.

10. The back-supported load-carrying mechanism of claim 9 further comprising a load support piece removably mounted to the frame between the two rear leg extensions, said load support piece providing an essentially horizontal support surface for a load being carried on the load-carrying mechanism.

11. The back-supported load-carrying mechanism of claim 9 further comprising means for removably mounting the load support piece to the frame, said means for removably mounting the load support piece including:

a second horizontal shaft extending through the load support piece and through a first vertical side and a second vertical side of the frame; and a removable fastener that holds the second horizontal shaft in the frame, said fastener enabling the second horizontal shaft to be slid out of the frame when the fastener is removed, thereby releasing the load support piece.

12. The back-supported load-carrying mechanism of claim 1 wherein a front surface of the lumbar support element includes a non-sliding foam inlay that contacts a user's back.

13. A back-supported load-carrying mechanism comprising:

a rigid frame having an upper portion and a lower portion, said lower portion including a first vertical side and a second vertical side forming an opening therebetween;

a horizontal shaft mounted to the first and second vertical sides and extending through the opening in the lower portion of the frame;

a lumbar support element pivotally mounted on the horizontal shaft, said lumbar support element extending horizontally from the first vertical side to the second vertical side of the frame, and extending vertically approximately halfway up the frame; and a suspension mechanism for mounting the horizontal shaft to the first and second vertical sides of the frame, said suspension mechanism enabling the horizontal shaft to move fore and aft in relation to the frame.

14. The back-supported load-carrying mechanism of claim 13 wherein the suspension mechanism enables each end of the horizontal shaft to move fore and aft independently of the other end.

15. The back-supported load-carrying mechanism of claim 14 further comprising two rear leg extensions on each side of the frame, said leg extensions providing support for the load-carrying mechanism and enabling the load-carrying mechanism to stand in an essentially vertical orientation when the load-carrying mechanism is removed by a user and placed on the ground.

16. The back-supported load-carrying mechanism of claim 15 wherein the lumbar support element is mounted in a position that allows the lumbar support element to rotate approximately 95 degrees, from a first position essentially aligned with the frame when the load-carrying mechanism is being worn by the user, to a second position essentially perpendicular to the frame when the load-carrying mechanism is removed by the user and utilized as a chair.

17. A back-supported load-carrying mechanism comprising:

a rigid frame having an upper portion and a lower portion, said lower portion having an opening therein; and a floating lumbar support element suspendably mounted in the opening in the lower portion so that the lumbar support element can pivot around a horizontal axis while also moving fore and aft in relation to the frame.

18. The back-supported load-carrying mechanism of claim 17 wherein the lower portion of the frame includes a first vertical side and a second vertical side, each of said vertical sides having an essentially horizontal slot formed therein, and wherein the lumbar support element is mounted on, and rotates around, a horizontal shaft that extends between the first and second vertical sides, each end of the horizontal shaft being mounted within one of the slots in the first and second vertical sides so that a force on the lumbar support causes the horizontal shaft to slide fore and aft in the slots.

19. The back-supported load-carrying mechanism of claim 18 further comprising two rear leg extensions on each side of the frame, said leg extensions providing support for the load-carrying mechanism and enabling the load-carrying mechanism to stand in an essentially vertical orientation when the load-carrying mechanism is removed by a user and placed on the ground.

20. The back-supported load-carrying mechanism of claim 19 further comprising a load support piece removably mounted to the frame between the two rear leg extensions, said load support piece providing an essentially horizontal support surface for a load being carried on the load-carrying mechanism.

* * * * *